US006123609A

United States Patent [19]

Satou

[11] Patent Number: 6,123,609

[45] Date of Patent: Sep. 26, 2000

[54] POLISHING MACHINE WITH IMPROVED POLISHING PAD STRUCTURE

[75] Inventor: Masaki Satou, Kumamoto, Japan

[73] Assignee: NEC Corporation, Tokyo, Japan

[21] Appl. No.: 09/138,573

[22] Filed: Aug. 24, 1998

[30] Foreign Application Priority Data

Aug. 22, 1997 [JP] Japan ..... 9-226759

[51] Int. Cl.[7] ..... B24B 29/00

[52] U.S. Cl. ..... 451/285; 451/287; 451/41; 451/63

[58] Field of Search ..... 451/285, 287, 451/41, 63, 533, 550

[56] References Cited

U.S. PATENT DOCUMENTS

| | | |
|---|---|---|
| 4,162,899 | 7/1979 | Molnar et al. . |
| 5,310,455 | 5/1994 | Pasch et al. . |
| 5,403,228 | 4/1995 | Pasch . |
| 5,516,400 | 5/1996 | Pasch et al. . |
| 5,534,106 | 7/1996 | Cote et al. . |
| 5,564,965 | 10/1996 | Tanaka et al. . |
| 5,624,304 | 4/1997 | Pasch et al. . |
| 5,876,269 | 3/1999 | Torii . |

FOREIGN PATENT DOCUMENTS 8-150557 6/1996 Japan .

*Primary Examiner*—Timothy V. Eley
*Assistant Examiner*—Willie Berry, Jr.
*Attorney, Agent, or Firm*—Young & Thompson

[57] ABSTRACT

In a polishing machine so configured that a surface to be polished of a wafer is brought into a sliding contact with a polishing pad spread over a rotating surface plate, while supplying a polishing liquid onto the polishing pad, for the purpose of polishing the surface to be polished of the wafer, the polishing pad includes a lower polishing web formed of a relatively soft material and spread on a surface of the rotating surface plate, and an upper polishing web formed of a relatively hard material and larger than the lower polishing web. The upper polishing web is laid on the lower polishing web with a double-adhesive-coated waterproof tape being interposed between the upper polishing web and the lower polishing web, so that a peripheral portion of the upper polishing web is bonded to a peripheral portion of the rotating surface plate with only the waterproof tape being interposed between the rotating surface plate and the peripheral portion of the upper polishing web. Thus, the lower polishing web is completely watertightly enclosed with the upper polishing web and the rotating surface plate, so that water included in the polishing liquid is prevented from immersing into the lower polishing web.

14 Claims, 3 Drawing Sheets

POLISHING MACHINE WITH IMPROVED POLISHING PAD STRUCTURE

BACKGROUND OF THE INVENTION

1. Field of the Invention

The present invention relates to a polishing machine, and more specifically to a polishing machine with an improved polishing pad structure, used for planarizing a concavo-convex surface of a wafer in a semiconductor device manufacturing process.

2. Description of Related Art

In a semiconductor device manufacturing field, recently, a chemical mechanical polishing (abbreviated to "CMP") has been used for polishing convex portions of a wafer surface in order to planarize the wafer surface.

In order to carry out this CMP, for example, a polishing machine as shown in FIG. 3 is used. This prior art polishing machine mainly comprises a rotating surface plate 3 having an upper surface on which a polishing pad composed of an upper polishing web 1 and a lower polishing web 2 are spread, a polishing liquid supply mechanism 6 for supplying a polishing liquid containing a polishing powder (abrasives) 7 onto the upper polishing web 1, and a wafer holder 4 for holding a wafer 5.

The rotating surface plate 3 has a center shaft 3S coupled with a motor 3M, so that the rotating surface plate 3 is driven to rotate in a direction "A". On the other hand, the wafer holder 4 has a center shaft 4S coupled with a motor 4M included in a not-shown driving mechanism, so that the wafer holder 4 is driven to rotate in a direction "B" and also to move in a direction "C". Here, a mechanism for moving the wafer holder 4 in the direction "C" is omitted in the drawing for simplification of the drawing, since the shown polishing machine is well known to persons skilled in the art. With this arrangement, the wafer 5 and the upper polishing web 1 can be brought into a sliding contact with each other, and also can be separated from each other.

In order to actually polish the wafer by use of the above mentioned polishing machine, first, the wafer 5 is held by the wafer holder 4 in close contact with the wafer holder 4, and is rotated together with the wafer holder 4. On the other hand, the rotating surface plate 3 is rotated, and the polishing liquid containing the polishing powder 7 is supplied onto the polishing web 1 from the polishing liquid supplying mechanism 6. In this condition, the wafer 5 is brought into a sliding contact with the upper polishing web 1 with the polishing powder 7 being interposed between the wafer 5 and the upper polishing web 1. As a result, the wafer 5 is polished. Here, the upper polishing web is formed of a hard material, so that a concavo-convex surface of the wafer 5 is planarized. On the other hand, the lower polishing web is formed of a soft material, for the purpose of making possible to polish the wafer while following a contours of the wafer.

Specifically, in order to obtain a good polished planarization without damaging the wafer 5, a polishing sheet formed of a foamed polyurethane having the hardness controlled to a predetermined hardness is used as the upper polishing web 1. On the other hand, in order to follow the contours of the wafer, a non-woven fabric formed of polyurethane fibers is used as the lower polishing web 2.

When the non-woven fabric is used as the lower polishing web 2 as mentioned above, a water content of the polishing liquid containing the polishing powder 7 inevitably immerses into the lower polishing web 2 through an exposed peripheral end 2E of the lower polishing web 2, with the result that the hardness of the lower polishing web 2 lowers, and as shown in FIG. 4, the polishing rate of a peripheral portion of the wafer 5 becomes larger than that of a center portion of the wafer 5. Why this phenomenon occurs will be described with reference to FIG. 5.

Referring to FIG. 5, because of the rotation of the rotating surface plate 3, the upper polishing web 1 and the lower polishing web 2 move in relation to the wafer 5 in a direction "D" which corresponds to a circumferential direction of the rotating surface plate 3. As a result, as shown in FIG. 5, a peripheral portion 5E of the wafer 5 firstly contacting with the moving upper polishing web 1 dents into the upper polishing web 1 because of friction with the upper polishing web 1. At this time, if the lower polishing web 2 contains the water, since the hardness of the lower polishing web 2 has become low, the denting amount becomes large. As a result, the wafer 5 is inclined on the upper polishing web 1, so that the load is concentrated onto the peripheral portion 5E of the wafer, and therefore, the polishing rate becomes large at the peripheral portion 5E of the wafer.

In order to overcome this problem, Japanese Patent Application Pre-examination Publication No. JP-A-08-241878 (an English abstract of JP-A-08-241878 is available from the Japanese Patent Office and the content of the English abstract of JP-A-08-241878 is also incorporated by reference in its entirety into this application) proposes a polishing pad as shown in FIG. 6. This proposed polishing pad is characterized in that an lower polishing web 2A has a number of square pillars separated from one another, and an upper polishing web piece 1A having an area larger than a top area of the square pillar is adhered onto the top area of the square pillar, so that an eaves of the upper polishing web piece 1A is formed on the square pillars of the lower polishing web 2A. This structure is intended to uniformly polish the wafer.

However, since a gap exists between the upper polishing web piece 1A, the water inevitably immerses into the lower polishing web 2A, so that the hardness of the lower polishing web 2A changes, and therefore, the polishing characteristics inevitably changes.

SUMMARY OF THE INVENTION

Accordingly, it is an object of the present invention to provide a polishing machine which has overcome the above mentioned problems of the prior art.

Another object of the present invention is to provide a polishing machine with an improved polishing pad structure having a stable polishing characteristics by preventing the immersion of water into a lower polishing pad.

The above and other objects of the present invention are achieved in accordance with the present invention by a polishing machine so configured that a surface to be polished of a wafer is brought into a sliding contact with a polishing pad spread over a rotating surface plate while supplying a polishing liquid onto the polishing pad, for the purpose of polishing the surface to be polished of the wafer, wherein the polishing pad at least includes a lower polishing web formed of a relatively soft material and spread on a surface of the rotating surface plate and an upper polishing web formed of a relatively hard material and spread to completely cover the whole of the lower polishing web in a watertight manner so as to prevent water included in the polishing liquid from immersing into the lower polishing web.

In an embodiment of the polishing machine, the upper polishing web is larger than the lower polishing web, and a peripheral portion of the upper polishing web is bonded to a peripheral portion of the rotating surface plate with no lower polishing web being interposed between the rotating surface plate and the peripheral portion of the upper polishing web, so that the lower polishing web is completely watertightly enclosed with the upper polishing web and the rotating surface plate.

Specifically, the peripheral portion of the upper polishing web is bonded to the peripheral portion of the rotating surface plate with the intermediary of a bonding layer in such a manner that no lower polishing web exists between the peripheral portion of the upper polishing web and the rotating surface plate, and the bonding layer is interposed between at least the peripheral portion of the upper polishing web and the rotating surface plate. Preferably, the bonding layer has a waterproof property. More preferably, the bonding layer is a double-adhesive-coated waterproof tape.

In addition, the lower polishing web is formed of a non-woven fabric. Each of the lower polishing web and the upper polishing web is formed of polyurethane.

The above and other objects, features and advantages of the present invention will be apparent from the following description of preferred embodiments of the invention with reference to the accompanying drawings.

DESCRIPTION OF THE PREFERRED EMBODIMENTS

Figure 1:
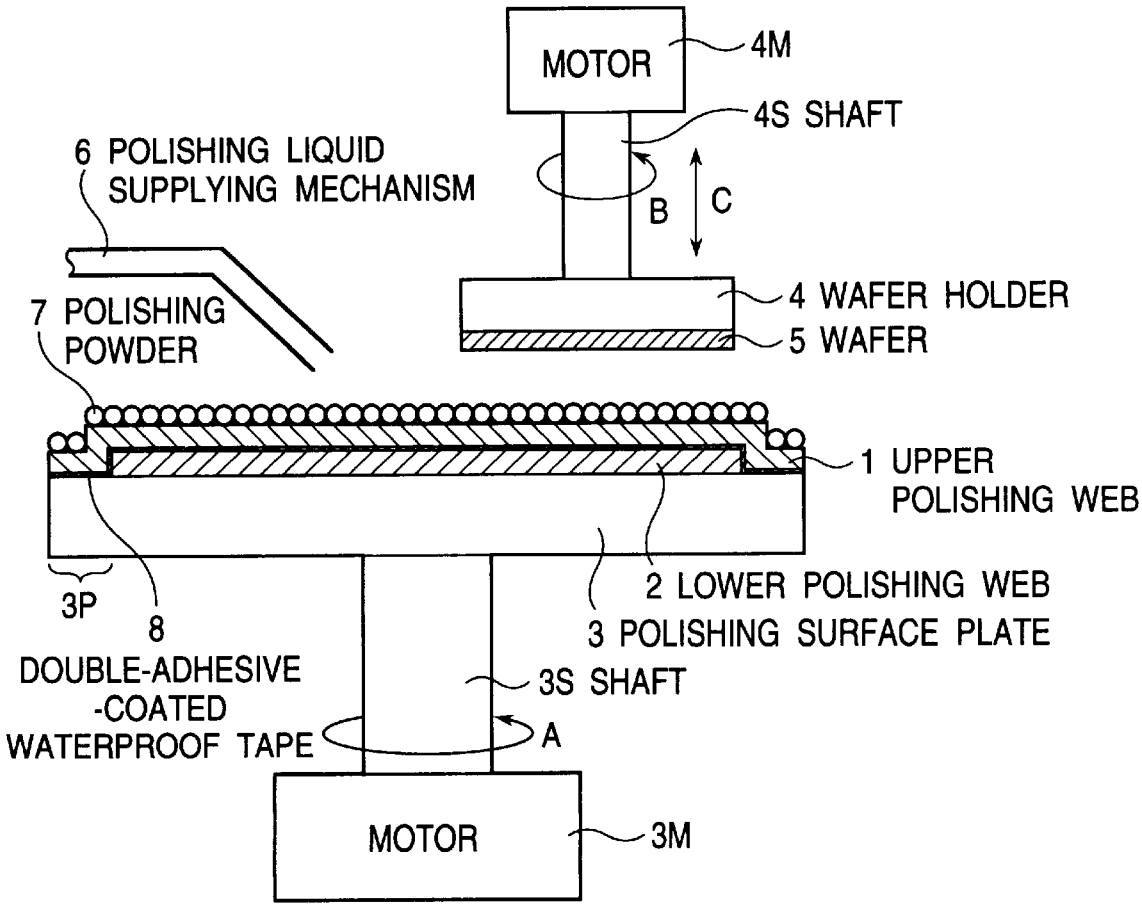
FIG. 1 is a diagrammatic section view of an embodiment of the polishing machine in accordance with the present invention.

Now, an embodiment of the polishing machine in accordance with the present invention will be described with reference to FIG. 1, which is a diagrammatic section view of the embodiment of the polishing machine in accordance with the present invention. In FIG. 1, elements corresponding to those shown in FIG. 3 are given the same Reference Numerals, and explanation will be omitted for simplification of description.

Figure 3:
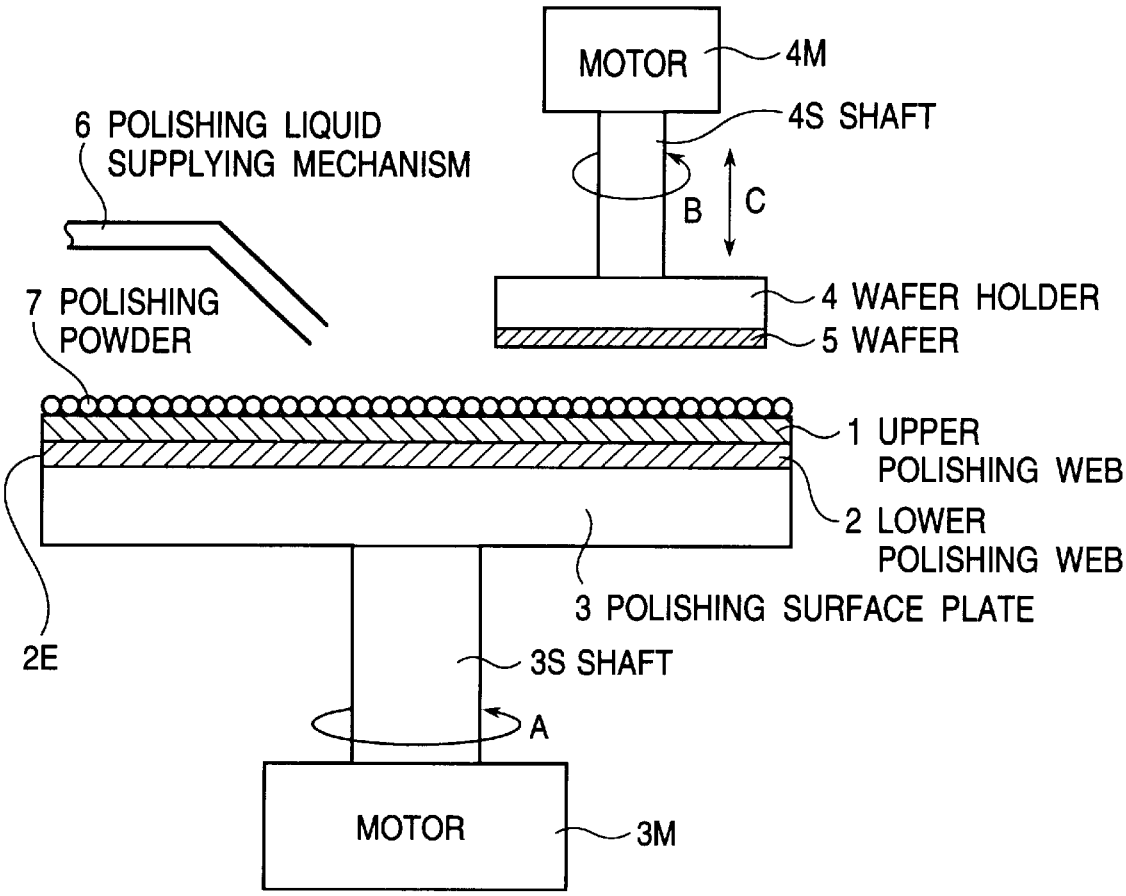
Fig. 3 PRIOR ART
FIG. 3 is a diagrammatic section view of an example of the prior art polishing machine.
Figure 4:
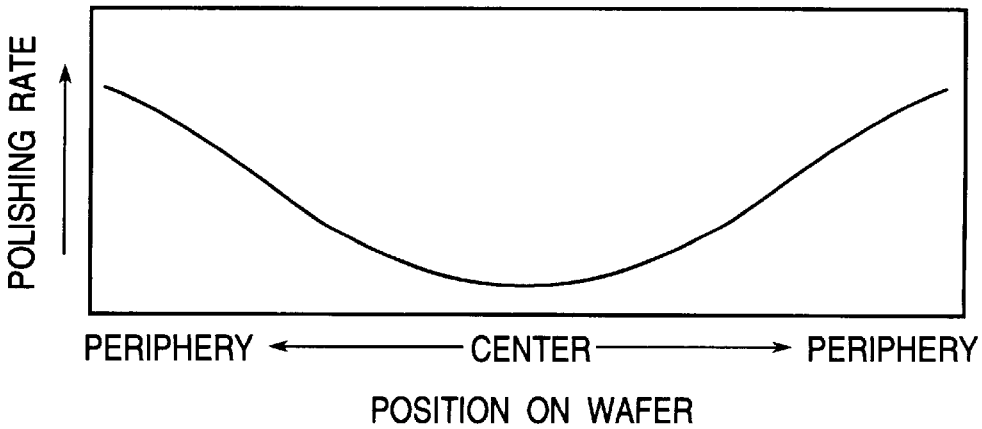
Fig. 4 PRIOR ART
FIG. 4 is a graph illustrating the polishing rate distribution over the wafer surface in the prior art polishing machine shown in FIG. 3
Figure 5:
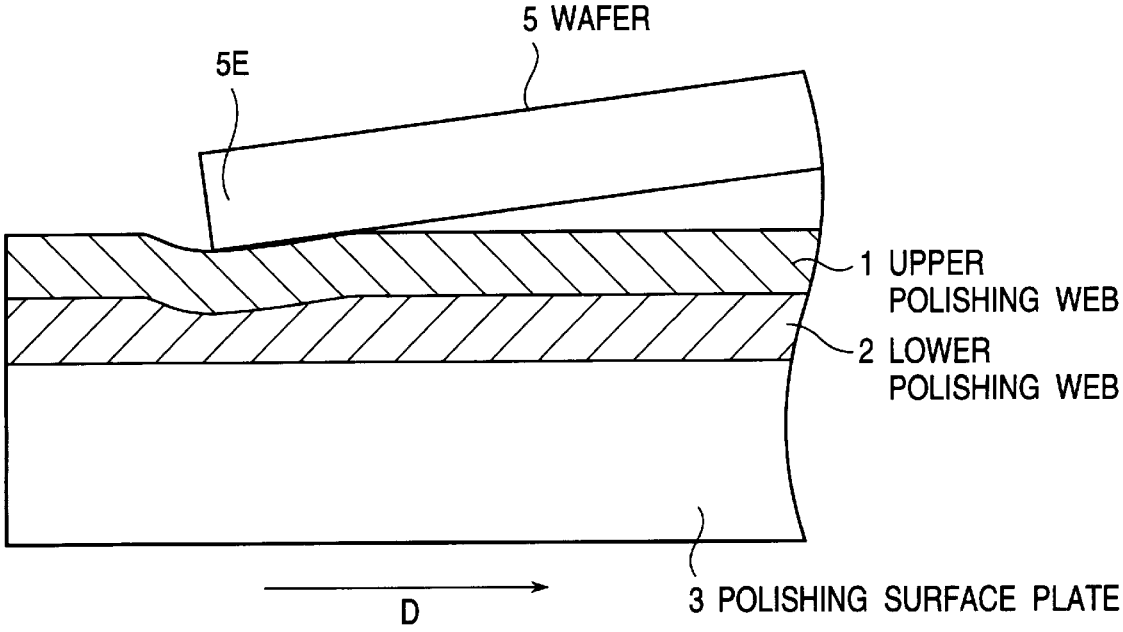
Fig. 5 PRIOR ART
FIG. 5 is an enlarged partial sectional view of the wafer and the polishing pad for illustrating the problem of the prior art polishing machine.
Figure 6:
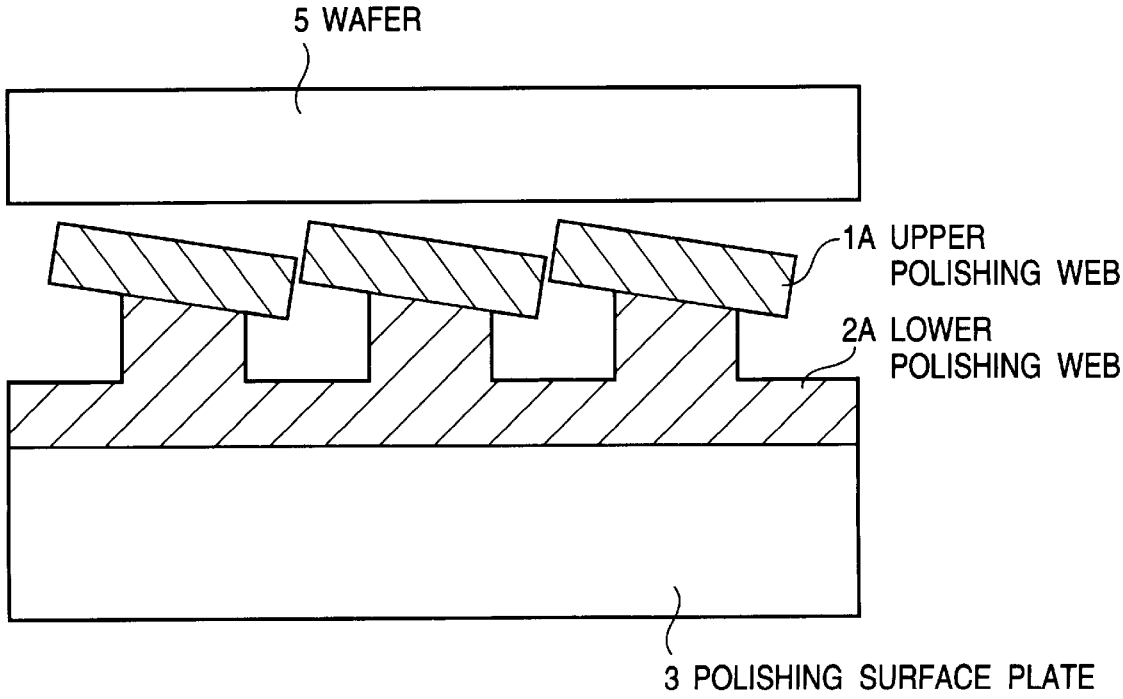
Fig. 6 PRIOR ART
FIG. 6 is an enlarged partial sectional view of the wafer and the polishing pad for illustrating another example of the prior art polishing machine.

As seen from comparison between FIG. 1 and FIG. 3, the shown embodiment is characterized in that an upper polishing web 1 formed of for example a soft polyurethane non-woven fabric, is larger in diameter than a lower polishing web 2 formed of for example a hard foamed polyurethane sheet, and the upper polishing web 1 is spread to completely cover the lower polishing web 2 and the upper polishing web 1 is adhered to the lower polishing web 2 and a rotating surface plate 3 with the intermediary of a double-adhesive-coated waterproof tape 8 (having upper and lower surfaces coated with adhesive, respectively). Namely, the whole of a lower surface of the upper polishing web 1 is completely covered with the double-adhesive-coated waterproof tape 8, which is adhered to the lower polishing web 2 and a peripheral portion 3P of the rotating surface plate 3. Thus, a peripheral portion of the upper polishing web 1 is bonded to the peripheral portion 3P of the rotating surface plate 3 with only the adhesive waterproof tape 8 being interposed between the rotating surface plate 3 and the peripheral portion of the upper polishing web 1. Therefore, the lower polishing web 2 is completely watertightly enclosed with the upper polishing web 1 and the rotating surface plate 3.

With the above mentioned arrangement, since the lower polishing web 2 is completely covered with the upper polishing web 1, a polishing liquid including the polishing powder 7, exemplified by a silica particles, is flowed out from a peripheral edge of the upper surface of the upper polishing web 1 to the outside of the rotating surface plate 3. Water included in the polishing liquid including the polishing powder 7 is prevented from immersing into the lower polishing web.

Figure 2:
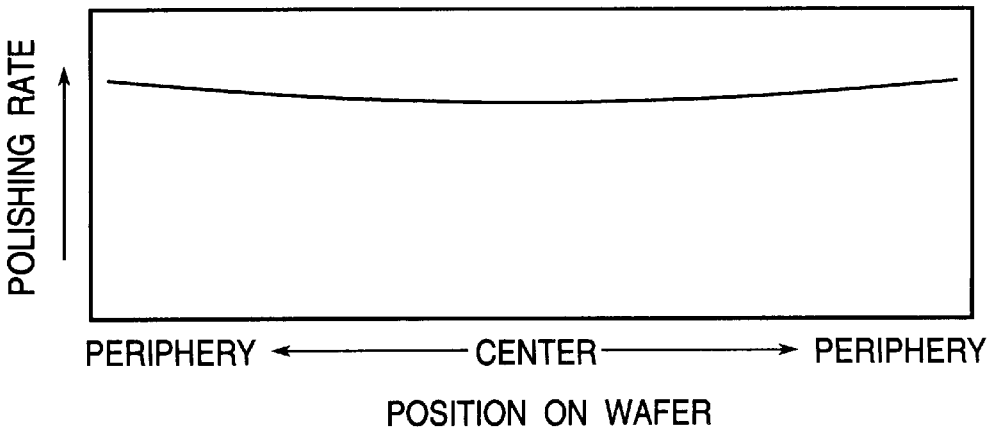
FIG. 2 is a graph illustrating the polishing rate distribution over the wafer surface in the polishing machine in accordance with the present invention.

A wafer was polished by using the above mentioned polishing machine. FIG. 2 is a graph illustrating the distribution of the polishing rate over the wafer surface in a diameter direction. It would be understood that the polishing rate is stabilized to become uniform over the wafer surface from its center to its peripheral edge.

As mentioned hereinbefore in connection with the prior art polishing machine, the water immerses into the lower polishing web through an exposed peripheral end of the lower polishing web in the prior art polishing machine. Therefore, it is important to watertightly seal the exposed peripheral end of the lower polishing web by the upper polishing web. Under this circumstance, in place of completely covering the upper polishing web with the double-adhesive-coated waterproof tape 8, only the peripheral portion of the upper polishing web 1 can be bonded to the peripheral portion 3P of the rotating surface plate 3 with the intermediary of a bonding layer. Even in this case, since the lower polishing web 2 is completely enclosed with the upper polishing web 1 and the rotating surface plate 3, the immersion of water can be prevented apparently excellently in comparison with the prior art polishing machine. In this case, the bonding layer is preferred to have a waterproof property, and actually, a double-adhesive-coated waterproof tape can be used as the bonding layer.

However, in order to realize a complete watertight-sealing of the lower polishing web 2 and to prevent a relation displacement between the lower polishing web 2 and the upper polishing web 1, it is most preferable to completely cover the lower surface of the upper polishing web with the double-adhesive-coated waterproof tape 8 so that the peripheral portion of the upper polishing web is watertightly bonded to the peripheral portion 3P of the rotating surface plate 3 with the intermediary of the double-adhesive-coated waterproof tape 8, and the whole upper surface of the lower polishing web is bonded to the upper polishing web with the intermediary of the waterproof tape, and furthermore, and the lower polishing web is completely watertightly enclosed with the upper polishing web and the rotating surface plate.

As mentioned above, since the soft lower polishing web is completely covered with the hard upper polishing web, the polishing liquid can be prevented from immersing into the lower polishing web, with the result that a stable polishing rate can be obtained uniformly over the whole wafer surface. This can elevate the yield of production of the semiconductor device which is expected to have a further elevated integration density and a further advanced multilayer structure.

The invention has thus been shown and described with reference to the specific embodiments. However, it should be noted that the present invention is in no way limited to the details of the illustrated structures but changes and modifications may be made within the scope of the appended claims.

What is claimed is:

1. A polishing machine for polishing a wafer, comprising:

a rotatable surface plate;

a lower polishing pad on said surface plate; and an upper polishing pad that encloses exposed portions of said lower polishing pad in a watertight seal and that is harder than said lower polishing pad, an upper surface of said upper polishing pad being a polishing surface for polishing a wafer brought into sliding contact therewith.

2. A polishing machine for polishing a wafer, comprising:

a rotatable surface plate;

a lower polishing pad on said surface plate; and an upper polishing pad that encloses exposed portions of said lower polishing pad in a watertight seal and that is harder than said lower polishing pad, an upper surface of said upper polishing pad being a polishing surface for polishing a wafer brought into sliding contact therewith, wherein surface plate has a first diameter, said lower polishing pad has a diameter smaller than the first diameter, and said upper polishing pad has a diameter substantially the same as the first diameter.

3. The polishing machine of claim 2, wherein a lower surface of said upper polishing pad is adhered to a peripheral side edge of said lower polishing pad and to a periphery of an upper surface of said surface plate.

4. A polishing machine for polishing a wafer, comprising:

a rotatable surface plate;

a lower polishing pad on said surface plate; and an upper polishing pad that is larger and harder than said lower polishing pad and completely covers said lower polishing pad in a watertight seal, an upper surface of said upper polishing pad being a polishing surface for polishing a wafer brought into sliding contact therewith, a periphery of said upper polishing pad being bonded to a periphery of said surface plate without said lower polishing pad being disposed between the bonded peripheries of said upper polishing pad and said surface plate so that said lower polishing pad is enclosed by said upper polishing web and said surface plate.

5. The polishing machine of claims 4, further comprising a bonding layer between the peripheries of said upper polishing pad and said surface plate.

6. A polishing machine claimed in claim 5 wherein said bonding layer has a waterproof property.

7. A polishing machine claimed in claim 5 wherein said bonding layer is a double-adhesive-coated waterproof tape.

8. A polishing machine claimed in claim 4 wherein said upper polishing web has a lower surface completely covered with a double-adhesive-coated waterproof tape, which is adhered to said lower polishing web and said peripheral portion of said rotating surface plate.

9. A polishing machine claimed in claim 8 wherein said lower polishing web is formed of a non-woven fabric.

10. A polishing machine claimed in claim 9 wherein each of said lower polishing web and said upper polishing web is formed of polyurethane.

11. A polishing machine for polishing a wafer, comprising:

a rotatable surface plate;

a lower polishing pad on said surface plate; and an upper polishing pad that completely covers said lower polishing pad and that is harder than said lower polishing pad, an upper surface of said upper polishing pad being a polishing surface for polishing a wafer brought into sliding contact therewith; and a waterproof bonding layer completely covering a lower surface of said upper polishing web, said waterproof bonding layer being adhered to and completely covering said lower polishing web and a peripheral portion of said surface plate, forming a watertight seal that encloses said lower polishing web between said waterproof bonding layer and said surface plate.

12. A polishing machine claimed in claim 11 wherein said waterproof bonding layer is a double-adhesive-coated waterproof tape.

13. A polishing machine claimed in claim 11 wherein said lower polishing web is formed of a non-woven fabric.

14. A polishing machine claimed in claim 13 wherein each of said lower polishing web and said upper polishing web is formed of polyurethane.

* * * * *